United States Patent [19]

Peterson et al.

[11] Patent Number: 4,903,744

[45] Date of Patent: Feb. 27, 1990

[54] SIDE LOADING DEBARKING/DELIMBING APPARATUS AND METHOD

[75] Inventors: Arnold N. Peterson; Larry A. Sprague, both of Eugene, Oreg.

[73] Assignee: Peterson Pacific Corp., Eugene, Oreg.

[21] Appl. No.: 238,905

[22] Filed: Aug. 30, 1988

[51] Int. Cl.[4] ..... B27L 1/00

[52] U.S. Cl. ..... 144/341; 144/2 Z; 144/208 J; 144/343

[58] Field of Search ..... 144/2 Z, 208 R, 208 J, 144/341, 343

[56] References Cited

U.S. PATENT DOCUMENTS 4,787,431 11/1988 Demlow ..... 144/341

*Primary Examiner*—W. Donald Bray

*Attorney, Agent, or Firm*—Robert L. Harrington

[57] ABSTRACT

A debarking/delimbing apparatus and method wherein logs are continuously handled by a stem hauling skidder continuously throughout the debarking/delimbing operation. The debarking/delimbing apparatus is provided with a side loading entry into the debarking/delimbing flails including a ramp or feed rollers for lateral ramping or feeding of tree stems up and through the side entry. A skidder-type stem hauler skids the tree stems toward the infeed entry, then tightly swings around the apparatus. The tree stems are swung out to the side of the apparatus and then back into the ramp to be ramped laterally into the flails. The skidder turns back to the infeed direction of travel to pull the tree stems in the conventional direction through the flails.

6 Claims, 2 Drawing Sheets

SIDE LOADING DEBARKING/DELIMBING APPARATUS AND METHOD

FIELD OF INVENTION

This invention relates to an apparatus and method of debarking and/or delimbing logs and particularly wherein a log hauling skidder or the like is able to bring logs to the debarking/delimbing apparatus, side load the logs into the apparatus and then pull the logs through the apparatus in a continuous handling operation.

BACKGROUND OF THE INVENTION

This invention is an improvement to the debarking-/delimbing apparatus of the commonly assigned U.S. Pat. Nos. 4,719,950, 4,721,139 and 4,729,415.

Skidders are a commonly used tractor-like vehicle that is very maneuverable and has a rear mounted grapple. They are used to grab onto the butt ends of felled trees (tree stems) and drag the tree stems (often a bundle of small sized tree stems) from a location in the woods where the trees have been felled to a designated in-field base site. A bundle may consist of one or two to eight or ten tree stems ranging in size from about four inches to about twenty inches in diameter. The bundles of tree stems are hauled through the woods a short distance to the site which will often include a portable tree stem processing apparatus for partially processing the stems. This base site and the portable apparatus are moved from time to time as required by the progress of the logging operation.

A number of processing steps may take place with the portable stem processing apparatus. In one example, tree stems are debarked and/or delimbed by a debarking/delimbing apparatus. Such delimbing apparatus have an inlet including guide roller for guiding the tree stems, butt end first, into and through the apparatus wherein flails beat against the stems to tear off the limbs and/or remove the bark. The debarked and/or delimbed stems are then loaded onto trucks for hauling to a permanently-sited stem processing mill or in some cases, they are further processed in the field as by feeding the stems into a chipper to be used for pulp wood.

The present invention is concerned with the manner of debarking/delimbing the tree stems with a portable debarking/delimbing apparatus. Presently the skidder or skidder-like apparatus simply stacks the tree stems at a location convenient to the apparatus. The stems must be regrappled by a boom mounted grapple, inwardly from the butt end, and fed butt end first into the inlet of the debarking/delimbing apparatus. As the guide rollers and flails of the apparatus take control over the stems, the grapple releases that bundle and returns for a second bundle. The tree stems that emerge from the debarking-/delimbing apparatus must again be handled a third time, e.g. for truck loading, stacking or chipping.

BRIEF DESCRIPTION OF THE PRESENT INVENTION

It is an object of the present invention to reduce the handling of the tree stems. This is accomplished by providing in the preferred embodiment a debarking-/delimbing apparatus with a side opening including a guide ramp for guiding tree stems laterally into the flailing station of the apparatus.

The inlet and in-feed direction for feeding of the tree stems into the apparatus remains essentially the same. The side loading chute, however, enables the commonly used skidder to approach the apparatus in a manner whereby the tree stems are headed toward the inlet. As the skidder comes up to the apparatus, it takes a sharp turn around the apparatus on the side of the side-opening. The skidder continues its sharp turn around to the outlet of the flailing station and turns back to the original path, i.e. aligned with the front in-feed opening.

The tree stems being dragged, for the most part, do not follow the zigzag pattern of the skidder. However, the portion of the stem bundle just rearward of the skidder grapple engages the side-opening ramp and is forced up the ramp laterally into the debarking/delimbing flails. By the time this has occurred, the skidder is directed away from the apparatus in line with the direction of in-feed to the flailing station, and the remainder of the log bundle is pulled through the apparatus to debark and/or delimb the tree stems in the conventional manner.

The log stems which continue to be engaged by the skidder grapple are then taken by the skidder to the stacking or loading site to be loaded on trucks or further processed as desired. The continuous skidder handling process eliminates at least one and more likely two handling operations and thereby adds substantial efficiency to the log processing operation.

The full scope and understanding will be more fully appreciated by reference to the following detailed description and drawings.

DETAILED DESCRIPTION

Figure 2:
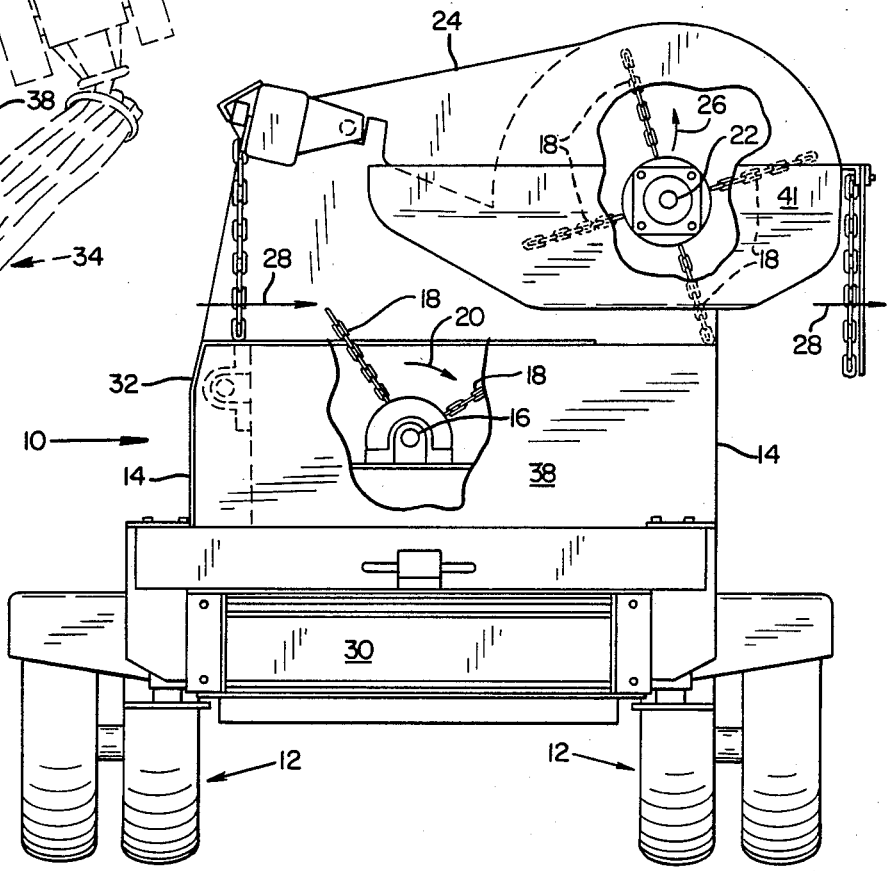
FIG. 2 is a side or end view of the apparatus of FIG. 1 (cross way to the direction of infeed) with parts removed for illustration purposes.

Reference is first made to the FIG. 2 illustration of a flail-type debarking/delimbing apparatus in accordance with the invention. The components for infeeding of the stem bundle and for removing the bark and/or limbs is best illustrated in this view. They are common to known debarking/delimbing apparatus of the prior art. A more detailed description of these components will be found in the commonly assigned U.S. Pat. Nos. 4,719,950, 4,721,139 and 4,729,415.

The apparatus as illustrated is a portable unit and is accordingly mounted on wheels 12. The apparatus in general includes an enclosure or housing 14. A lower rotating shaft 16 carries a plurality of chain flails 18 that rotate as indicated by arrow 20. An upper rotating shaft 22 also carrying chain flails 18 is mounted on a portable or floating head 24 that pivots to move the shaft 22 up and down to adapt to different sizes of logs, as indicated by arrow 26.

Logs are fed into the apparatus between the upper and lower flails as generally indicated by directional arrows 28. The floating head 24 is adjusted by the log size to a desired height and the upper and lower flails cooperatively flail or beat the log with sufficient force to break off limbs and remove bark. The limbs and bark fall to the bottom of the housing and into an ejection chute 30 where a ram pushes the materials away from the apparatus. A power or guide roller 32 aids in feeding the logs through the apparatus. (All of these features are more fully described in the above-mentioned U.S. patents.)

Figure 3:
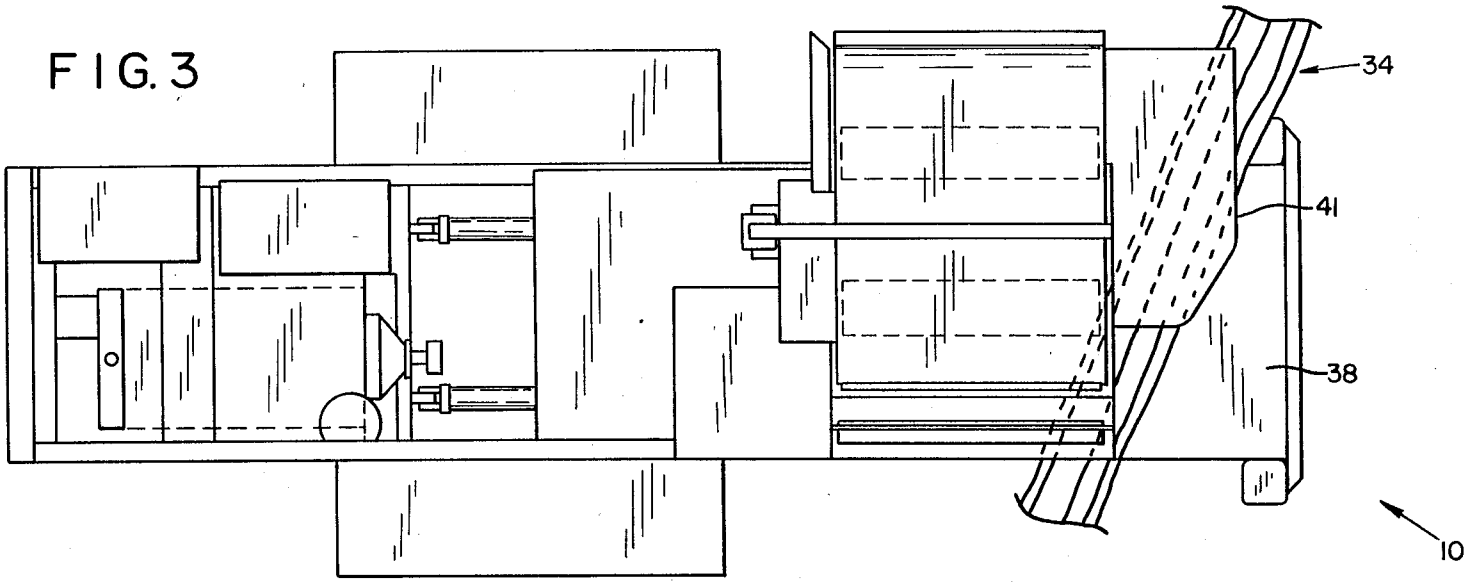
FIG. 3 is a top view of the apparatus of FIG. 1 illustrating a tree stem bundle being drawn into the flailing station thereof.
Figure 4:
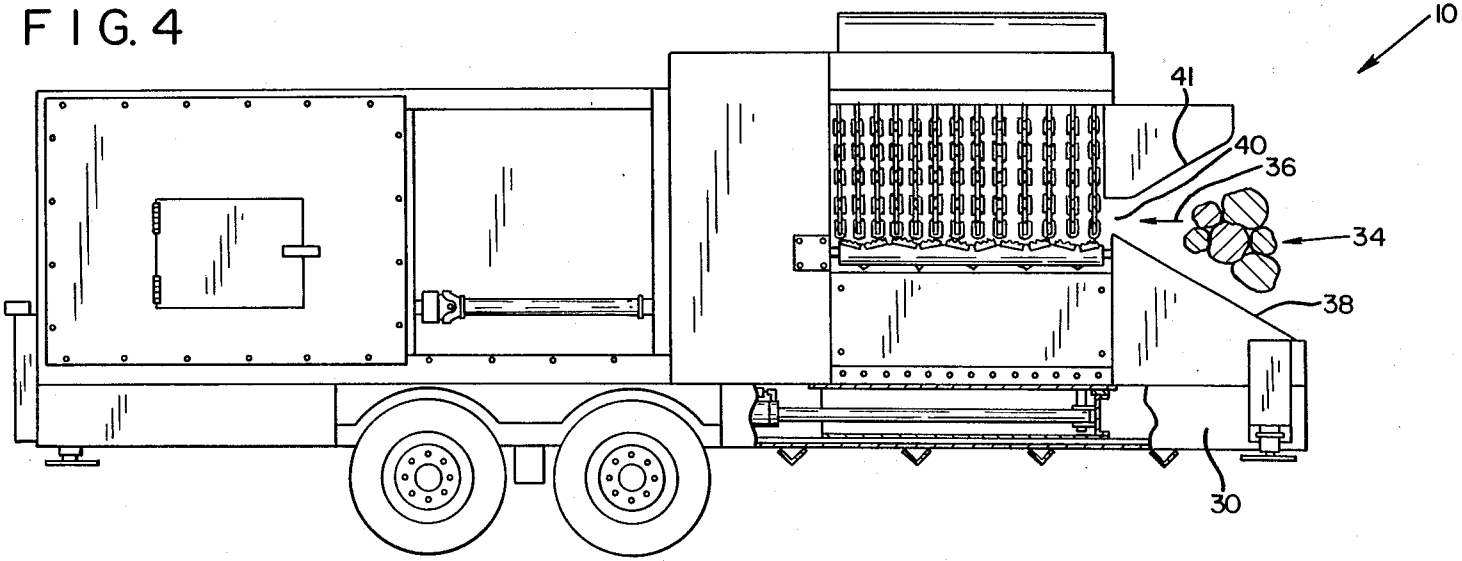
FIG. 4 is a side view of the apparatus of FIG. 1 also illustrating the bundle of tree stems being drawn into the flailing station thereof.

Reference is now made to FIGS. 3 and 4 which illustrate the features of improvement over the apparatus of the prior patents. The side wall of housing 14 is provided with a slotted opening 40 to permit lateral sliding of a stem bundle 34 into the chain flails or flailing station as indicated by arrow 36 in FIG. 4. A ramp 38 is mounted to the housing 14 (over discharge chute 30) for directing the bundle 34 up the ramp 38 and into the opening 40. An upper guide 41 cooperates with the ramp 38 to guide the bundle 34 into the opening 40.

OPERATION

Figure 1A:
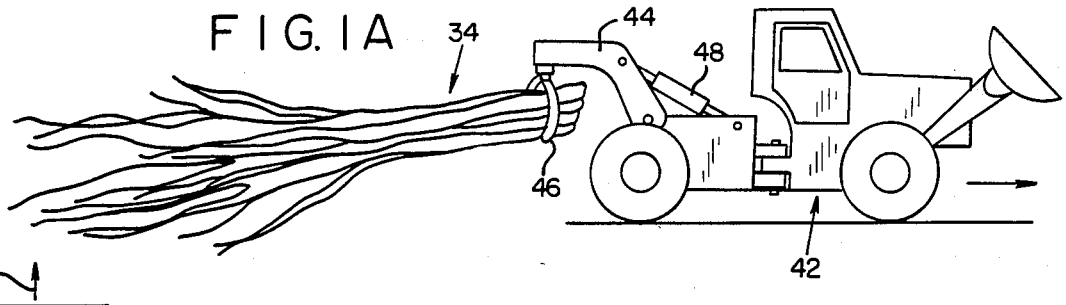
FIG. 1*a* is a side view of the skidder of FIG. 1 dragging or "skidding" a bundle of logs.
Figure 1:
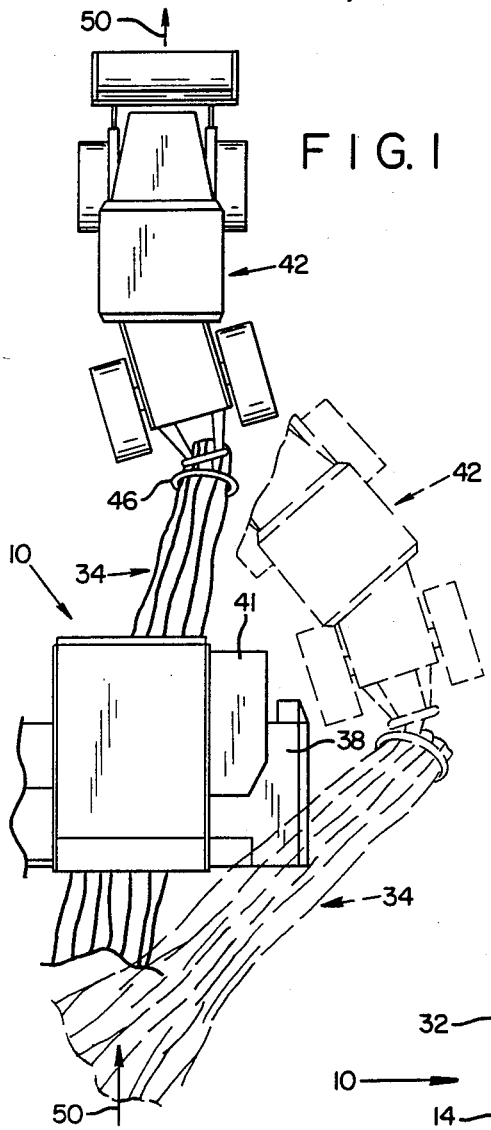
FIG. 1 is a plan view illustration of a skidder loading a bundle of tree stems into a side loading debarking-/delimbing apparatus in accordance with the present invention.

The process of loading the bundle 34 into the debarking/delimbing flails of the apparatus is illustrated in FIGS. 1 and 1*a*. As shown, skidder 42 is articulated for tight maneuvering. A rearwardly projected boom 44 carries a grapple 46 that is lowered and raised through hydraulic cylinder 48. The grapples themselves are opened and closed hydraulically by an operator in the cab of the skidder. The skidder itself is shown only in general as it is a commonly used apparatus for hauling logs out of the woods. The point that is here made is that the skidder is able to make tight turns and is provided with a grapple that is adjustable in height. It is designed to grapple the tree stems near or at the butt end, and drags the opposite or top end of the stems along the ground, i.e. they are skidded along the ground. However, there are apparatus for accomplishing this operation that are not considered to be skidders in the trade. One example may be a truck mounted boom. Apparatus that are able to perform the function of the skidder as described herein are generally referred to hereafter as skidder-type stem haulers.

Referring to FIG. 1, the skidder approaches the debarking/delimbing apparatus headed toward the inlet thereof as generally indicated by arrow 50. The tree stems are of course headed in the same direction. The skidder, upon approaching the apparatus makes a sharp turn around the apparatus and then back to original direction 50 as illustrated by the two skidder positions shown in FIG. 1. The trailing end of the bundle being dragged or skidded, advances very little during this maneuver. As the butt end of the bundle (following grapple 46) is brought into the side of the apparatus, the ground contact of the trailing end acts like an anchor or pivot and the bundle is forced laterally against the ramp 38. Ramp 38, in cooperation with guide 41, directs the bundle through slotted opening 40 and into the path of the flails. The skidder, upon continuation along direction 50, pulls the bundles through the flails 18 to be debarked and/or delimbed in the conventional manner.

A skilled operator of the skidder will accomplish the above maneuver with only a small portion of the butt end of the log bundle escaping the flails. The process is essentially non-stop and the operator simply continues to haul the stems to a stacking or loading site after having accomplished the debarking/delimbing operation. This entire operation occurs with little more time and effort than was previously required for simply stacking the tree stems alongside the debarking/delimbing apparatus.

The advantages of this invention will be very obvious to logging operators upon review of the disclosure herein. Numerous variations, modifications and changes will become apparent to those skilled in the art. Such changes are contemplated and encompassed by the claimed invention as defined in the claims appended hereto.

We claim:

1. An apparatus for debarking/delimbing tree stems comprising, a housing, debarking/delimbing members contained in the housing and defining a debarking/delimbing station having a front, rear and opposed sides, said housing having an inlet at the front of the station and an outlet at the rear of the station for directing tree stems into and through the debarking/delimbing station and establishing thereby a front-to-rear stem feeding direction, said housing having a side opening at one side of the debarking/delimbing station to permit entry of a stem bundle into the station directed crossway to the stem feeding direction, and said apparatus adapted to accommodate a vehicle pathway around the apparatus in close proximity to the side opening at the side of the debarking/delimbing station and thereby permit a skidder type stem hauler to circle around the housing on the pathway and in the process achieve lateral maneuvering of a stem bundle being hauled by the hauler through the side opening and into the debarking/delimbing station of the apparatus.

2. An apparatus as defined in claim 1 including ramping means positioned relative to the side opening for ramping the tree stems into the side opening.

3. An apparatus as defined in claim 2 wherein an upper guide on the housing suspended over the ramp aids in directing the stem bundle into the side opening.

4. An apparatus as defined in claim 3 wherein the debarking/delimbing members are flexible flails that are rotated on shafts above and below the position of a log being directed through the debarking/delimbing stations, and including a driven guide roller in cooperation with the rotating flails for assisting the feeding of the stem bundle through the debarking/delimbing stations.

5. A process for debarking/delimbing tree stems comprising;

providing an apparatus including a debarking-/delimbing station having a defined direction of infeed and further including a side entry into the station and means for feeding tree stems laterally relative to the defined direction, through the side entry and into position for movement in the defined direction, utilizing a skidder type stem hauler for butt-end grappling and skidding of tree stems generally along the infeed direction toward the debarking/delimbing station, said hauler maneuvered in a tight circle around the station to thereby first swing the butt ends of the tree stems to the side of the station and then laterally urge the butt ends through the side entry and into the flailing station, said hauler immediately turned back to the direction of infeed for drawing the tree stem portions following the grappled butt ends thereof through the station along the defined direction.

6. A process as defined in claim 5 wherein the trailing ends of the tree stem bundle drag on the ground and function like an anchor during the circling maneuver, said apparatus including ramping means leading into the side entry whereby said circling maneuver urges ramping of the tree stem bundle for lateral positioning thereof through said side entry.

* * * * *